United States Patent [19]

Adachi et al.

[11] Patent Number: 5,048,390

[45] Date of Patent: Sep. 17, 1991

[54] TONE VISUALIZING APPARATUS

[75] Inventors: Takeshi Adachi; Yasushi Kurakake; Hideo Suzuki; Kotaro Mizuno, all of Hamamatsu, Japan

[73] Assignee: Yamaha Corporation, Hamamatsu, Japan

[21] Appl. No.: 239,984

[22] Filed: Sep. 1, 1988

[30] Foreign Application Priority Data

| | | | |
|---|---|---|---|
| Sep. 3, 1987 | [JP] | Japan | 62-133930[U] |
| Sep. 3, 1987 | [JP] | Japan | 62-219248[U] |
| Sep. 10, 1987 | [JP] | Japan | 62-137597[U] |
| Sep. 10, 1987 | [JP] | Japan | 62-137598[U] |
| Sep. 11, 1987 | [JP] | Japan | 62-138321[U] |
| Oct. 2, 1987 | [JP] | Japan | 62-150553[U] |

[51] Int. Cl.[5] ..... G06K 15/00; A63J 17/00

[52] U.S. Cl. ..... 84/464 R; 84/608; 84/626; 84/662; 84/737; 381/48

[58] Field of Search ..... 84/464 R, 423 R, 601, 84/602, 608, 626, 662, 737, 454; 381/48

[56] References Cited

U.S. PATENT DOCUMENTS

| | | | |
|---|---|---|---|
| 3,969,972 | 7/1976 | Bryant | 381/48 X |
| 4,104,625 | 8/1978 | Bristow et al. | 381/48 X |
| 4,378,466 | 3/1983 | Esser | 84/464 R X |
| 4,434,697 | 3/1984 | Roses | 84/454 |
| 4,648,113 | 3/1987 | Horn et al. | 84/464 R X |
| 4,768,086 | 8/1988 | Paist | 84/464 R X |

*Primary Examiner*—Steven L. Stephan
*Assistant Examiner*—Emanuel Todd Voeltz
*Attorney, Agent, or Firm*—Spensley Horn Jubas & Lubitz

[57] ABSTRACT

A tone visualizing apparatus for visualizing an inputted audio signal to thereby display an image corresponding to this audio signal includes at least a detector, image display (such as a CRT display unit) and display controller. The detector detects characteristics of the audio signal such as envelope, chord, spectrum signal components, number of zero-cross points and energy of the audio signal. The image display displays an image based on given image information which can be generated from a video tape recorder (VTR), a video disk unit or an image memory constituted by a semiconductor memory. The display controller controls the image display so that a display parameter of the image will be controlled based on the detected characteristics of the audio signal. For example, the display parameter can be set as size, brightness or colors of the image. Thus, the image is controlled so that the impression of the image will be matched with that of the audio tone.

47 Claims, 13 Drawing Sheets

TONE VISUALIZING APPARATUS

BACKGROUND OF THE INVENTION

1. Field of the Invention

The present invention relates to a tone visualizing apparatus, and more particularly to a tone visualizing apparatus which controls a displayed image in response to a tone.

2. Prior Art

Conventionally, it is well known that certain kind of apparatus detects parameters such as tone volume, frequency etc. of a musical tone generated from an electronic musical instrument or a non-electronic musical instrument. Based on the detected parameters, this apparatus controls color or brightness of image displayed on a display screen of a CRT display unit and the like. By using this apparatus, it is possible to enjoy music by ears and also enjoy the image which varies in response to characteristics of music by eyes. Therefore, it is possible to effectively enjoy the music in auditory and visual aspects.

However, in the above-mentioned conventional apparatus, variation of the displayed image does not necessarily correspond to the characteristics of the inputted musical tone. Hence, there is a problem in that the conventional apparatus can not obtain high compatibility between the musical tone and the displayed image.

SUMMARY OF THE INVENTION

It is accordingly a primary object of the invention to provide a tone visualizing apparatus which improves the compatibility between an inputted audio signal and corresponding display image so that the musical tone and other audio signals can be effectively enjoyed in the auditory and visual aspects.

It is another object of the invention to provide a tone visualizing apparatus in which contents of display image are adequately controlled in response to a chord of musical tone or progress pattern of a chord so that the compatibility between the inputted musical tone and the display image will be raised.

It is still another object of the invention to provide a tone visualizing apparatus in which contents or display states of display image can be varied in response to deviation among higher harmonic wave components included in the audio signal of the musical tone etc. so that characteristics and images of the audio signal can be adequately expressed as the display image.

It is a further object of the invention to provide a tone visualizing apparatus in which color parameter can be controlled in response to number of zero crosses of the inputted musical tone signal so that the image of the inputted musical tone signal can be adequately expressed as the display image.

It is a still further object of the invention to provide a tone visualizing apparatus in which character of musical instrument can be expressed as the display image.

In a first aspect of the invention, there is provided a tone visualizing apparatus comprising:

(a) detecting means for detecting characteristics of an inputted audio signal;

(b) image display means for displaying an image based on given image information; and (c) display control means for controlling the image in response to the detected characteristics of the inputted audio signal.

In a second aspect of the invention, there is provided a tone visualizing apparatus comprising:

(a) detecting means for detecting a musical tone parameter of an inputted audio signal such as tone volume, tone color or frequency;

(b) image display means for displaying an image of object based on predetermined image information; and (c) display control means for controlling sense of distance of the image of object displayed by the image display means in response to variation of the musical tone parameter.

In a third aspect of the invention, there is provided a tone visualizing apparatus comprising:

(a) image memory for storing image information in advance;

(b) envelope detecting means for detecting an envelope of an inputted audio signal;

(c) display means for displaying an image including images of an object and its background based on the image information; and (d) display control means for controlling the display means so that size of the object will be magnified or reduced in response to the detected envelope of the inputted audio signal.

In a fourth aspect of the invention, there is provided a tone visualizing apparatus comprising:

(a) chord detecting means for detecting a chord based on a musical tone signal or musical tone performance information;

(b) image display means for displaying an image based on predetermined image information; and (c) display control means for varying contents of the image information in response to the chord detected by the chord detecting means.

In a fifth aspect of the invention, there is provided a tone visualizing apparatus comprising:

(a) chord detecting means for detecting a chord based on a musical tone signal or musical tone performance information;

(b) chord storing means for sequentially storing predetermined amount of chord information outputted from the chord detecting means;

(c) image display means for displaying an image based on predetermined image information;

(d) chord progress detecting means for detecting a chord progress pattern based on each chord information stored in the chord storing means; and (e) display control means for varying contents of the image information in response to the chord progress pattern detected by the chord progress detecting means.

In a sixth aspect of the invention, there is provided a tone visualizing apparatus comprising:

(a) spectrum extracting means for extracting a fundamental wave component having frequency $f_B$ and at least one higher harmonic component having frequency $f_n$ other than the fundamental wave component from spectrum signals included in an inputted audio signal;

(b) comparing means for calculating out n (where n denotes an integral number) times of the frequency $f_B$ (i.e., $n \times f_B$) which is the closest value of the frequency $f_n$, the comparing means comparing the value $n \times f_B$ with the frequency $f_n$ to thereby obtain a frequency difference $P_n$ thereof;

(c) image display means for displaying an image based on predetermined image information; and (d) display control means for varying content or display state of the image displayed by the image display means in response to the frequency difference $P_n$.

In a seventh aspect of the invention, there is provided a tone visualizing apparatus comprising:

(a) zero-cross detecting means for detecting and counting zero-cross points of an inputted musical tone signal;

(b) image display means for displaying an image based on predetermined image information; and (c) display control means for varying the image information to thereby vary color parameters of the image displayed by the image display means in response to number of the zero-cross points detected by the zero-cross detecting means.

In an eighth aspect of the invention, there is provided a tone visualizing apparatus comprising:

(a) tone source means for generating a musical tone signal;

(b) zero-cross detecting means for detecting and counting number of zero-cross points of the musical tone signal to thereby output a digital signal whose data represent the number of zero-cross points;

(c) digital-to-analog converting means for converting the digital signal into an analog signal;

(d) means for generating image information;

(e) image display means for displaying an image based on the image information outputted from the means; and (f) saturation control means for controlling saturation of display image in response to level of the analog signal outputted from the digital-to-analog converting means.

In a ninth aspect of the invention, there is provided a tone visualizing apparatus comprising:

(a) first energy detecting means for detecting first output energy quantity of a first musical tone generating source;

(b) second energy detecting means for detecting second output energy quantity of a second musical tone generating source;

(c) ratio detecting means for detecting a ratio between the first and second output energy quantities to thereby generate an output value thereof corresponding to the detected ratio;

(d) image display means for displaying an image based on predetermined image information; and (e) display control means for varying contents of the image information based on the output value of the ratio detecting means.

In a tenth aspect of the invention, there is provided a tone visualizing apparatus comprising:

(a) first energy detecting means for detecting first output energy quantity of a first musical tone generating source;

(b) second energy detecting means for detecting second output energy quantity of a second musical tone generating source;

(c) image memory means for storing image information;

(d) image display means for displaying an image based on the image information; and (e) display control means for calculating out an energy ratio between the first and second output energy quantities to thereby vary contents of the image information based on the energy ratio so that the image can be controlled.

In an eleventh aspect of the invention, there is provided a tone visualizing apparatus comprising:

(a) spectrum extracting means for extracting spectrum signal components from an inputted tone signal;

(b) image display means for displaying an image based on given image information; and (c) display control means for controlling number of display colors of the image displayed by the image display means in response to number of the spectrum signal components.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
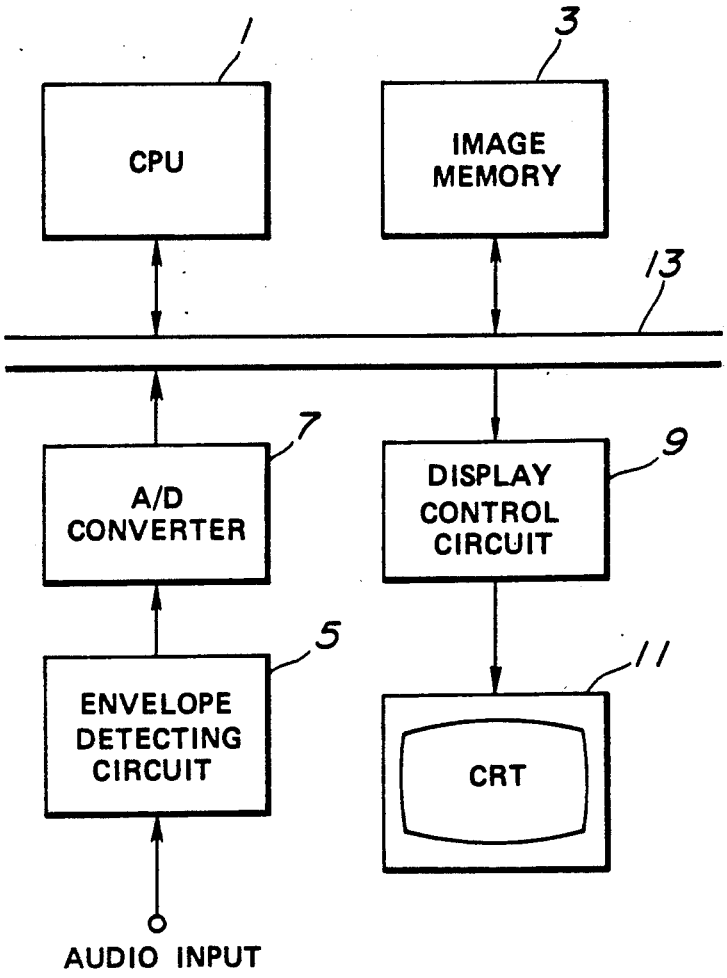
FIG. 1 is a block diagram showing a diagrammatical constitution of a tone visualizing apparatus according to a first embodiment of the present invention.

Next, description will be given with respect to the preferred embodiments by referring to the drawings wherein like reference characters designate like or corresponding parts throughout several views.

FIRST EMBODIMENT

FIG. 1 shows the diagrammatical constitution of the tone visualizing apparatus according to the first embodiment of the present invention. The apparatus shown in FIG. 1 comprises a central processing unit (CPU) 1 constituted by a microprocessor or the like; an image memory 3; an envelope detecting circuit 5 which inputs the musical tone signal and other audio signals; an analog-to-digital (A/D) converter 7; a display control circuit 9; a display unit 11 such as the CRT display unit; and a bus line 13. This bus line 13 mutually connects the CPU 1, the image memory 3, the A/D converter 7 and the display control circuit 9 together. It is possible to constitute the image memory 3 by use of a semiconductor memory, a video disk (VD) unit, a video tape recorder (VTR) unit or the like. In addition, the envelope detecting circuit 5 can be constituted by use of an AM (Amplitude Modulation) detector and an integration circuit which integrates output of this AM detector by a predetermined time constant, for example.

In the apparatus shown in FIG. 1, when the audio signal representative of the musical tone is inputted into the envelope detecting circuit 5, this audio signal is effected by AM detection and integration so that an envelope signal corresponding to scale (i.e., level or amplitude) of this inputted audio signal is generated. This envelope signal is converted into digital signal by the A/D converter 7, and the digital signal is supplied to the CPU 1 via the bus line 13. The CPU 1 transmits such digitized envelope signal to the display control circuit 9 via the bus line 13 at each timing of the predetermined time constant. The display control circuit 9 reads image information from the image memory 3, and then the display control circuit 9 displays an image including a predetermined object and its background on the display screen of the display unit 11 based on the read image information. As the predetermined object, it is possible to display an image of bicycle, train, drum and fife band or the like, for example. In the case where the display unit 11 is a three-dimensional image display unit such as a stereoscopic television, the image of object is displayed within the background image three-dimensionally. Then, as described before, the display unit 9 controls the display unit 11 to magnify or reduce the scale of displayed background image in response to the amplitude of envelope indicated by the envelope information which is supplied thereto via the bus line 13, so that mutual relation between the object and background will be changed and therefore sense of distance of the object will be controlled. In the case where the display unit 11 is the three-dimensional image display unit, the sense of distance between the object and/or the background image is controlled or the mutual relation between the object and the background is changed based on three-dimensional image control. Further, it is possible to adopt another method for controlling the sense of distance of object by varying position relation of the object within the background. For example, the display unit 11 displays an image in which a singer sings a song in front of the band at first. Then, it is possible to express the sense of distance of the singer from audience side by moving position of the singer to the center position or backward position.

Incidentally, the first embodiment detects the envelope and then performs image control in response to variation of the detected envelope. However, instead of the envelope, it is possible to detect other musical tone parameters such as tone color, tone volume and frequency in the first embodiment.

SECOND EMBODIMENT

Figure 2:
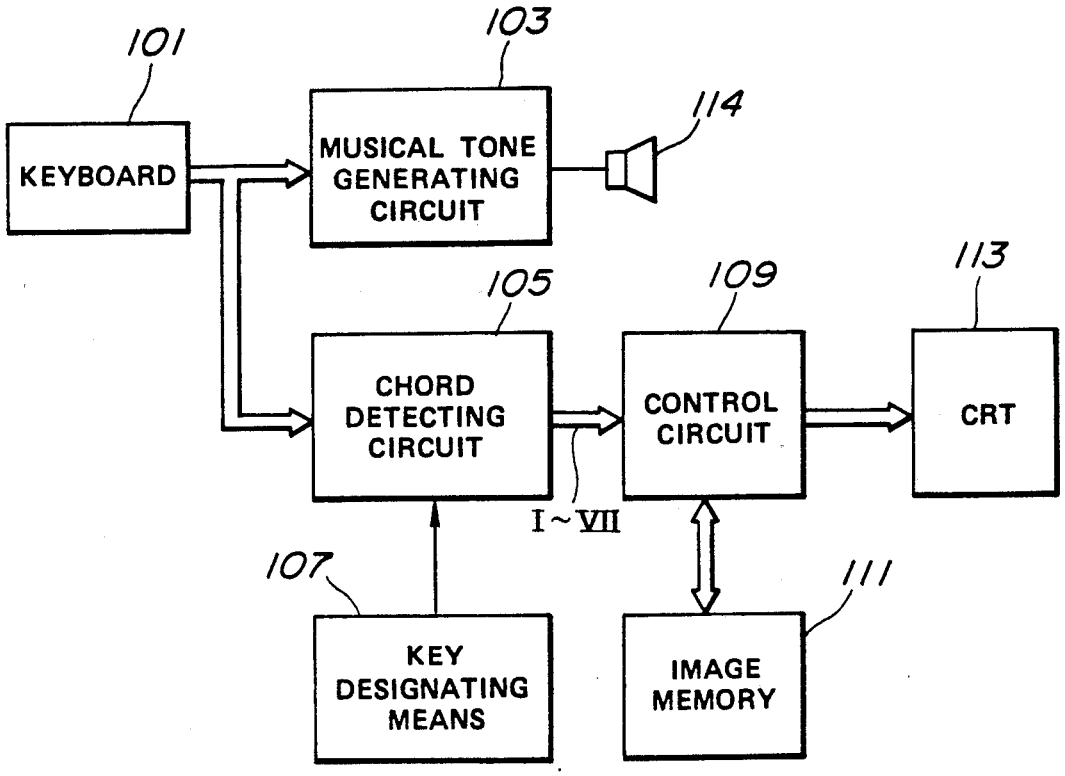
FIG. 2 is a block diagram showing a diagrammatical constitution of a tone visualizing apparatus according to a second embodiment of the present invention.

FIG. 2 shows the diagrammatical constitution of the tone visualizing apparatus according to the second embodiment of the present invention. The apparatus shown in FIG. 2 comprises a keyboard 101; a musical tone generating circuit 103 for generating a musical tone signal corresponding to performance of the keyboard 101 based on key information generated from the keyboard 101; a chord detecting circuit 105 for detecting chords included in the musical tones performed by the keyboard 101 based on the key information from the keyboard 101; a key designating means 107 constituted by a switch and the like; a control circuit 109; an image memory 111; a display unit 113 constituted by the CRT display unit and the like; and a speaker 114. Meanwhile, the apparatus shown in FIG. 2 includes a portion of the electronic musical instrument such as the keyboard 101 and the musical tone generating circuit 103. In this case, this portion of the electronic musical instrument can be constituted as another unit independent from this tone visualizing apparatus according to the second embodiment.

In this apparatus shown in FIG. 2, the musical tone generating circuit 103 generates the musical tone signal corresponding to the operation (i.e., performance) of the keyboard 101, and this musical tone signal is supplied to the speaker 114 wherein the musical tone corresponding to the musical tone signal will be generated. The chord detecting circuit 105 detects the chord based on combination of depressed keys within the keyboard 101 to thereby output chord information, which is supplied to the control circuit 109. In this case, the key designating means 107 executes key designation. Hence, the chord detecting circuit 105 detects the chord in the designated key. More specifically, the chord detecting circuit 105 judges that the detected chord corresponds to which of chord of first degree (or I-degree), chord of second degree (or II-degree), . . . , and chord of seventh degree (or VII-degree). The control circuit 109 displays predetermined image on a display screen of the display unit 113 based on image information stored in the image memory 111 in advance. When the chord detecting circuit 105 supplies the chord information to the control circuit 109, the control circuit 109 changes contents of display image in response to the chord information. For example, the display unit 113 displays an image including an image of human face in advance, and then an expression of this human face will be changed in response to a chord type of the detected chord. Or, it is possible to change complexion of the displayed human face in response to the chord information. In this case, each of the chord kinds has its own character by which specific impression can be given to a listener. Hence, the contents of display image will be changed in response to this character of each chord type. For example, each of the chords of I-degree to VII-degree in C major key may correspond to each image which will be described as follows:

Chord of I-degree (in C major) for laughing face;

Chord of II-degree (in D minor) for embarrassed face;

Chord of III-degree (in E minor) for sulky face;

Chord of IV-degree (in F major) for gentle face;

Chord of V-degree (in G major) for lording face;

Chord of VI-degree (in A minor) for relieved face; and

Chord of VII-degree (in G Sevens) for tense face.

Incidentally, there are several kinds of chords other than the above-mentioned chords, and each kind of chord has its specific character. Therefore, the display control can be executed in response to the character of each kind of chord. In general, major chord has a character by which happy impression is given to the listener, while minor chord has a character by which dark and sad impression is given to the listener. For this reason, it is possible to control the expression of human face based on whether the generated chord belongs to the major chords or minor chords. In addition, it is possible to modify the second embodiment so that the displayed human can be exchanged by every key and the expression of displayed human can be varied in response to each chord in each key.

THIRD EMBODIMENT

Figure 3:
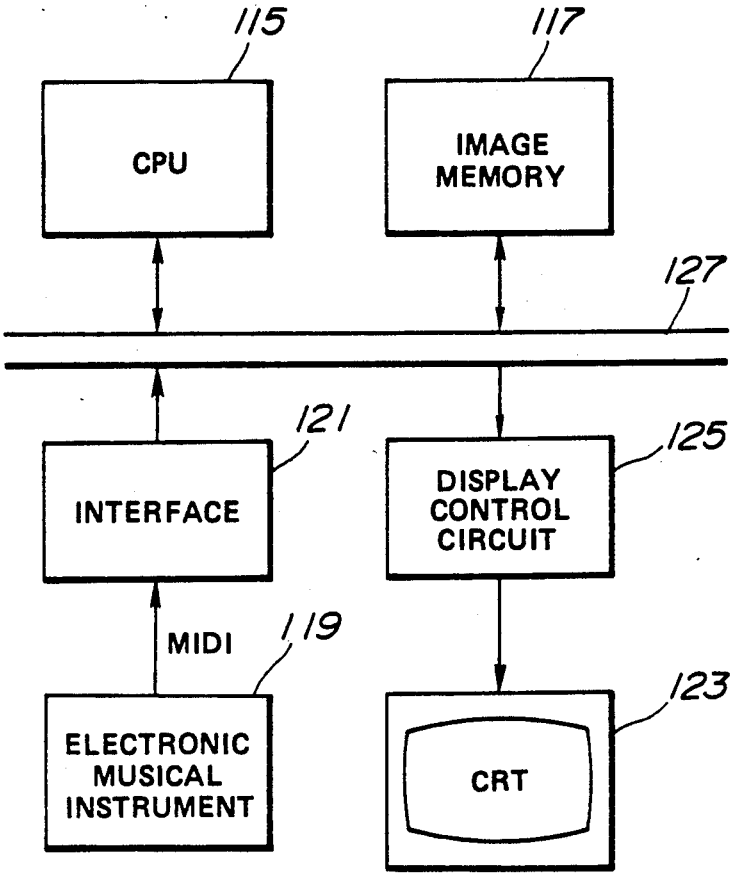
FIG. 3 is a block diagram showing a diagrammatical constitution of a tone visualizing apparatus according to a third embodiment of the present invention.

FIG. 3 shows the diagrammatical constitution of the tone visualizing apparatus according to the third embodiment of the present invention. The apparatus shown in FIG. 3 comprises a CPU 115 constituted by the microprocessor and the like; an image memory 117; an electronic musical instrument 119 having the keyboard etc., for example; an interface circuit 121 connected with the electronic musical instrument 119; a display unit 123 such as the CRT display unit; a display control circuit 125; and a bus line 127 for connecting these several portions. The image memory 117 can be constituted by a read only memory (ROM), the video disk unit or the like. The electronic musical instrument 119 transmits performance information by Musical Instrument Digital Interface (MIDI) standard to the interface circuit 121 wherein data formation of such performance information is converted into data formation suitable for internal process of the CPU 115. Further, the CPU 115 includes a memory device (not shown) in the third embodiment.

Figure 4:
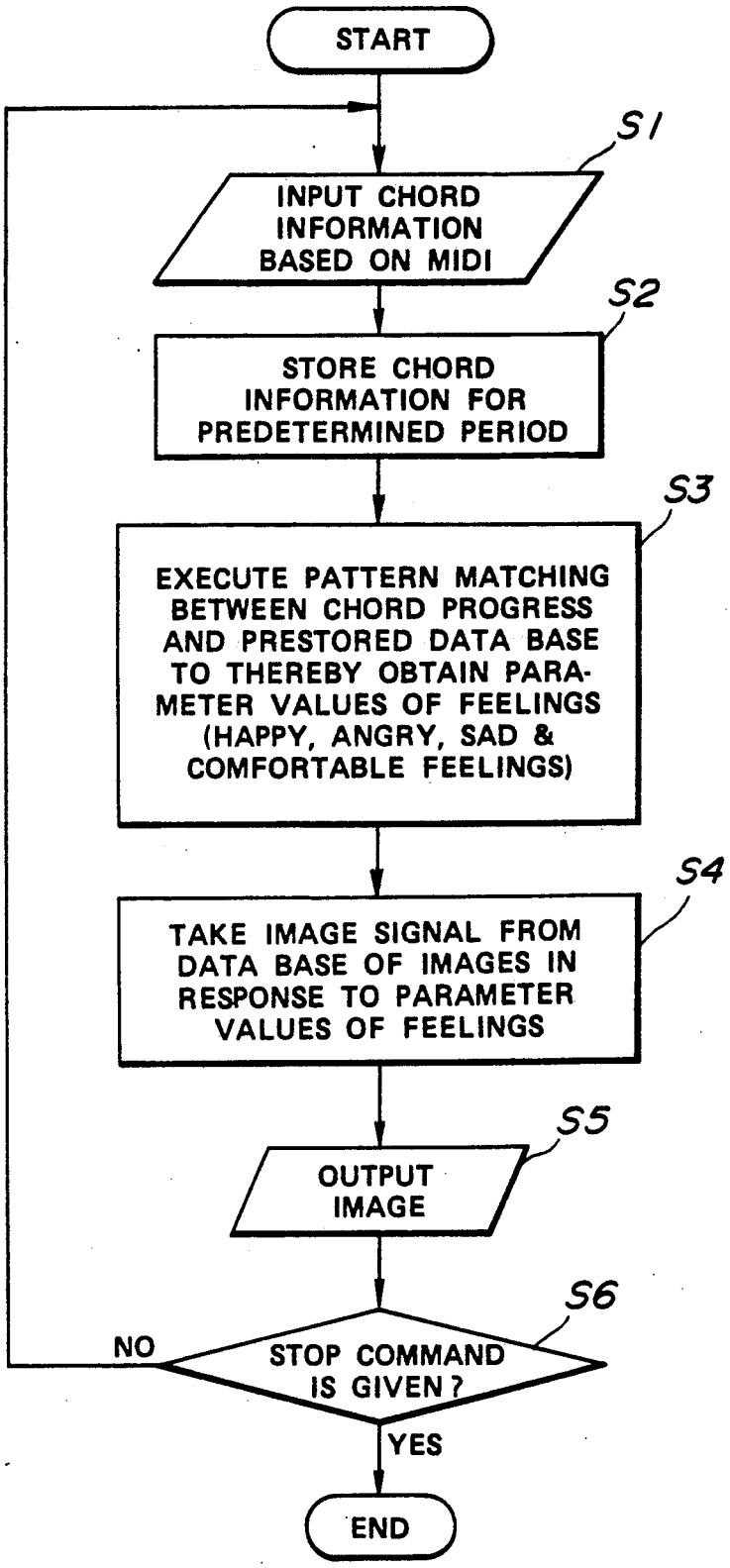
FIG. 4 is a flowchart for explaining an operation of the tone visualizing apparatus shown in FIG. 3.

Next, description will be given with respect to operations in the case where the image displayed on the display screen of the display unit 123 is controlled in response to variation (i.e., chord progress pattern) of the chord included in the musical tone signal or the performance information outputted from the electronic musical instrument 119 in the apparatus shown in FIG. 3 by referring to the flowchart shown in FIG. 4. As shown in FIG. 4, the electronic musical instrument 119 outputs the performance information of MIDI standard in response to the performance thereof, and then this performance information is supplied to the CPU 115 via the interface circuit 121 (in a step S1). The CPU 115 detects the chord at each timing based on key-depression information included in the inputted performance information thereof, and then the CPU 115 sequentially stores the detected chord information into the internal memory thereof for the predetermined period (in a step S2). Thereafter, the CPU 115 sequentially inputs the chord information representative of four chords by every input timing thereof. Based on such chord information representative of four chords, the CPU 115 detects the chord progress pattern as described below.

The CPU 115 executes pattern matching between the detected chord information and data base stored in the internal memory thereof in advance so that the CPU 115 immediately detects the chord progress information. Based on such chord progress information, the CPU 115 obtains parameter values of feelings of human (such as happy, angry, sad and comfortable feelings) (in a step S3). As the above data base, the CPU 115 stores the parameter values of four feelings of human wherein degree of each feeling is evaluated by five points full. For example, in case of "I, V, I, I" of chord progress pattern in the tune entitled "Butterfly", the parameter values designate four-point degree of happy feeling, zero-point degree of angry feeling, zero-point degree of sad feeling and five-point degree of comfortable feeling. The CPU 115 takes the image information out of the image memory 117 in response to the parameter values of feelings, and this image information is supplied to the display unit 123 via the display control circuit 125 so that the corresponding image is displayed on the display screen of the display unit 124 (in steps S4 and S5). Thus, the image corresponding to the chord progress pattern of the musical tone information is sequentially displayed. Thereafter, the CPU 115 executes the image display process until stop command is given thereto or the tune is ended (in a step S6).

In order to obtain the parameters of feelings described before, questionnaires are taken by some groups so as to obtain information concerning the feelings each graded on the basis of five points by listening chord progress of four bars of the existing tune, for example. Hence, data base concerning the accurate evaluation of feelings will be obtained by adjusting the point of each feeling based on the above information. Meanwhile, in order to correspond each parameter value with the image, motion picture or still picture of about five seconds is used as one unit of image and the parameters of feelings are added to each unit of image in advance, for example. Similar to the above-mentioned data base, such added parameters of feelings are adjusted by referring to the questionnaires and evaluations of picture writers, so that the image corresponding to the parameters of feelings will be determined. For example, the image in which a butterfly is flying around a flower garden corresponds to "parameter of feelings"=(4,0,0,5).

In the above description, the apparatus shown in FIG. 3 displays the image in correspondence with each chord progress. However, instead of the apparatus shown in FIG. 3, it is possible to operate the apparatus shown in FIG. 2 so that this apparatus can also display the image in correspondence with each chord progress.

FOURTH EMBODIMENT

Figure 5:
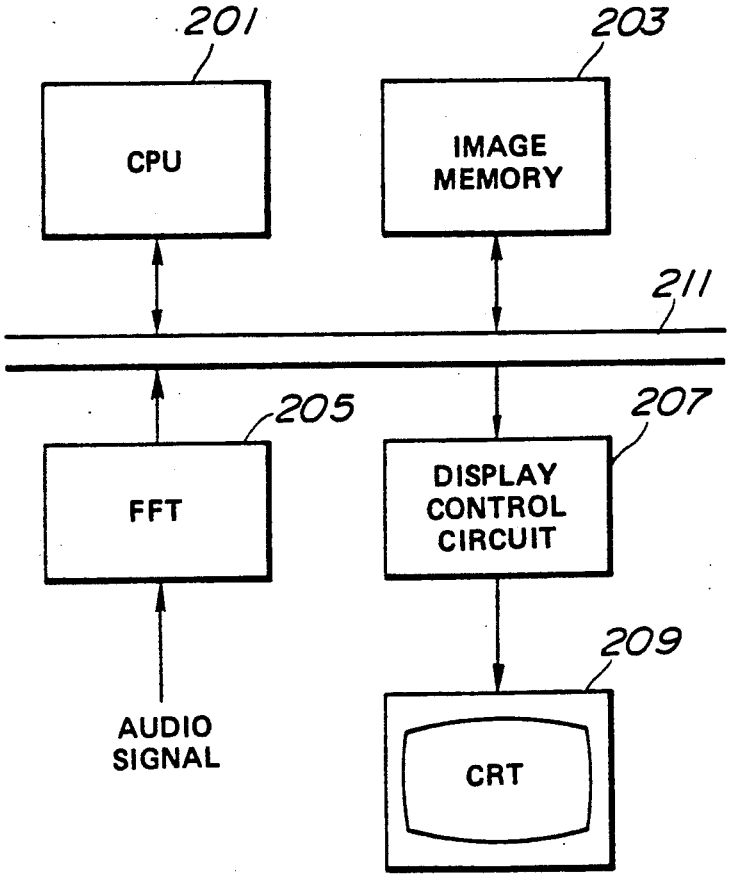
FIG. 5 is a block diagram showing a diagrammatical constitution of a tone visualizing apparatus according to a fourth embodiment of the present invention.

Next, description will be given with respect to the fourth embodiment of the present invention. FIG. 5 shows the diagrammatical constitution of the tone visualizing apparatus according to the fourth embodiment of the present invention. This apparatus shown in FIG. 5 comprises a CPU 201 constituted by the microprocessor and the like; an image memory 203; a Fast Fourier Transform (FFT) circuit 205 for executing fast Fourier transform of an inputted audio signal; a display control circuit 207 a display unit 209 such as the CRT display unit; and a bus line 211 which mutually connects the CPU 201, the image memory 203, the FFT circuit 205 and the display control circuit 207 together.

Figure 6A:
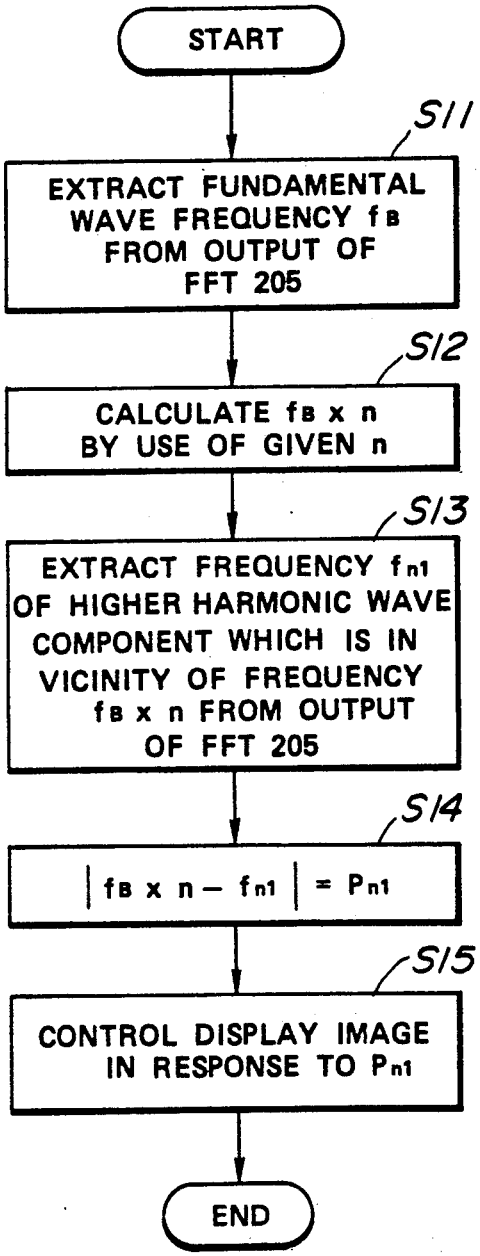
FIGS. 6A and 6B are flowcharts each showing an operation of the tone visualizing apparatus shown in FIG. 5.

Next, description will be given with respect to the operation of the apparatus shown in FIG. 5 by referring to FIG. 6A. The FFT circuit 205 receives and then executes the fast Fourier transform on the inputted audio signal such as the musical tone signal so that the audio signal will be divided into spectrum signals. The CPU 201 extracts a signal of fundamental wave component from the spectrum signals outputted from the FFT circuit 205, and then the frequency of this extracted signal is denoted as $f_B$, which is stored in the CPU 201 (in a step S11). Further, the CPU 201 calculates out value of $f_B \times n$ by use of a given number n (in a step S12). Thereafter, the CPU 201 extracts a higher harmonic wave component whose frequency is in the vicinity of the calculated frequency of $f_B \times n$ from the components outputted from the FFT circuit 205, and then the CPU 210 stores the frequency of the extracted higher harmonic wave component as $f_{n1}$ (in a step S13). In this case, n is set as some natural number which is larger than one. Next, the CPU 201 obtains the absolute value of frequency difference between the frequency of $f_B \times n$ and the frequency $f_{n1}$, and then this absolute value is denoted as frequency difference $P_{n1}$ (in a step S14). Thereafter, the CPU 201 supplies the value of this frequency difference $P_{n1}$ to the display control circuit 207 via the bus line 211.

Based on the image information read from the image memory 03, the display control circuit 207 displays some image on the display screen of the display unit 209. However, when the information including the frequency difference $P_{n1}$ is inputted into the display control circuit 207 via the CPU 201 as described before, the display control circuit 207 varies the contents or display states of the display image in response to the frequency difference $P_{n1}$ (in a step S15). In response to increase of the frequency difference $P_{n1}$, color balance of the display image can be shifted; magnitude of color signal component can be varied; or clearness of outlines of the display image can be varied under control of the display control circuit 207, for example. In order to shift the color balance of the display image, mixing ratio of three color signals R, G, B must be varied, for example. In order to control outline characteristic of the display image, the constants of known peaking circuit or aperture compensating circuit must be varied in response to the frequency difference $P_{n1}$ so that frequency characteristics and/or phase characteristics of the image signal will be varied. Such techniques are well known, hence, detailed description thereof will be omitted. Thus, the contents or display states of the display image can be controlled in response to the deviation of frequency of the higher harmonic wave component.

Figure 6B:
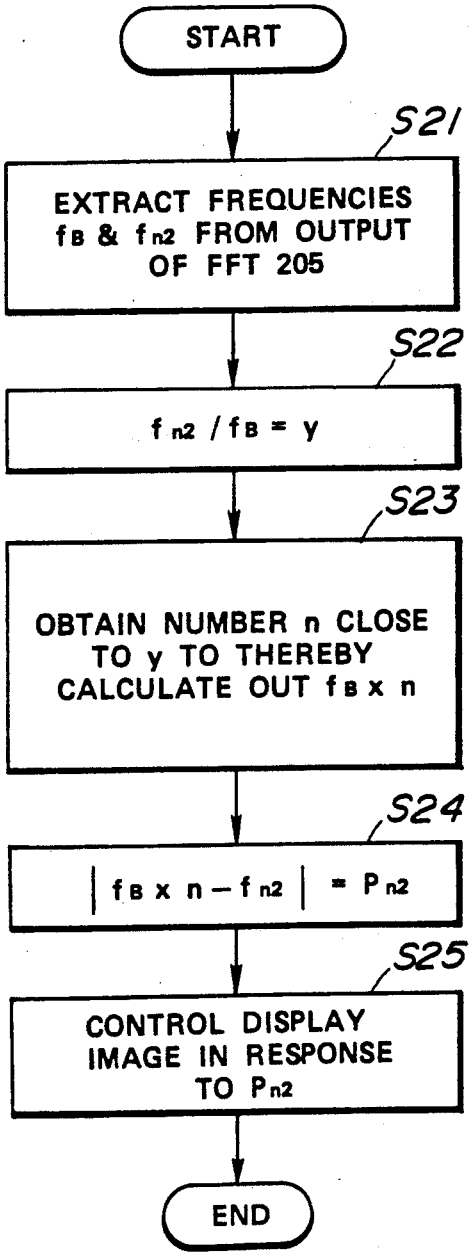

Meanwhile, it is possible to obtain the frequency difference $P_n$ (which designates the deviation degree of the higher harmonic wave component) in accordance with a process as shown in FIG. 6B, for example. FIG. 6B shows an example wherein n is not designated in advance. More specifically, the CPU 201 extracts the frequency $f_B$ of fundamental wave component and another frequency $f_{n2}$ of arbitrary higher harmonic wave component other than the fundamental wave component (in a step S21), and then frequency ration between the frequencies $f_B$ and $f_{n2}$ is denoted as y (in a step S22). In this case, the CPU 201 obtains number n which is normally an integral number and also in the vicinity of the value y, and then the CPU 201 calculates out the frequency $f_B \times n$ (in a step S23). Thereafter, the CPU 201 obtains a frequency difference $P_{n2}$ between the frequency $f_B \times n$ and the frequency $f_{n2}$ (in a step S24), so that the CPU 201 and the display control circuit 207 perform the image control as described before based on this frequency difference $P_{n2}$ (in a step S25).

Incidentally, it is possible to set the number n as one value. Or it is possible to sequentially vary the number n. In this case, it is possible to obtain the frequency difference $P_n$ with respect to each of the number n and then transmit this frequency difference $P_n$ to the display control circuit 207.

In addition, the frequency difference $P_n$ is not limited to the absolute value. It is possible to control the display image based on positive/negative value (which designates a deviation direction) represented by the frequency difference $P_n$. Further, it is possible to obtain the frequency differences with respect to plural higher harmonic wave components so that the display image will be controlled by adequate combination of the frequency differences.

FIFTH EMBODIMENT

Figure 7:
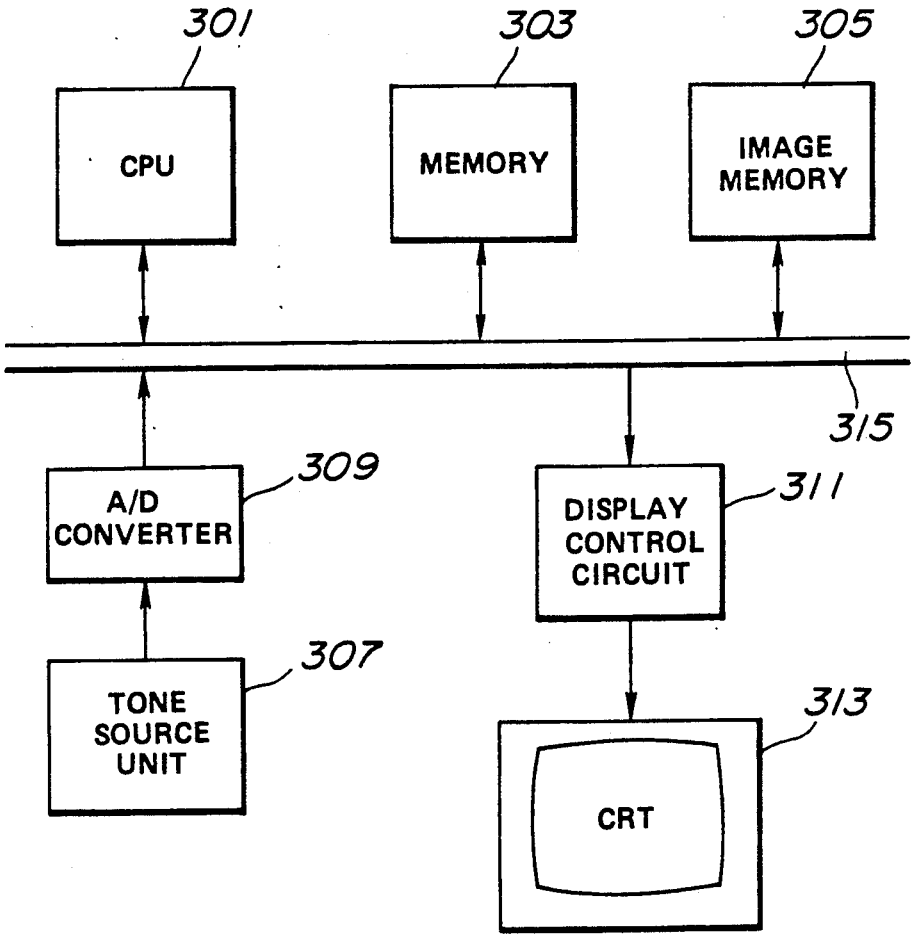
FIG. 7 is a block diagram showing a diagrammatical constitution of a tone visualizing apparatus according to a fifth embodiment of the present invention.

FIG. 7 shows the diagrammatical constitution of the tone visualizing apparatus according to the fifth embodiment of the present invention. The apparatus shown in FIG. 7 comprises a CPU 301 constituted by the microprocessor etc., for example; a memory 303 for storing several kinds of data; an image memory 305; a tone source unit 307 such as the electronic musical instrument, an audio unit or the like; an A/D converter 309 for converting an analog signal outputted from the tone source unit 307 into a digital signal; a display control circuit 311; a display unit 313 such as the CRT display unit; and a bus line 315 for mutually connecting the CPU 301, the memory 303, the image memory 305, the A/D converter 309 and the display control circuit 311 together.

Figure 8:
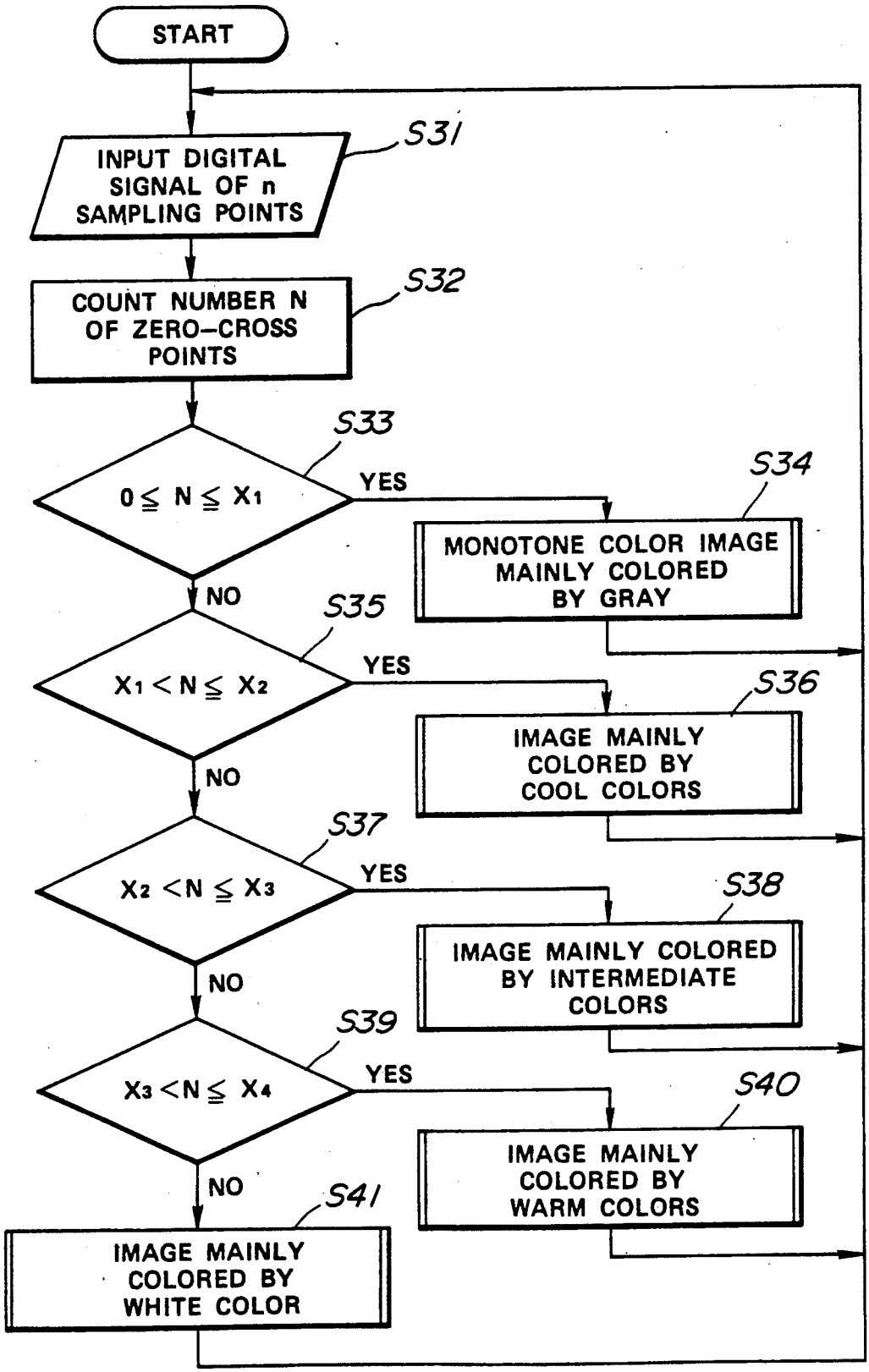
FIG. 8 is a flowchart for explaining an operation of the apparatus shown in FIG. 7.

As shown in FIG. 8, the musical tone signal or the like outputted from the tone source unit 307 is converted into the digital signal in the A/D converter 309, and then the memory 303 sequentially inputs and stores this digital signal of predetermined n sampling points (in a step S31). The CPU 301 sequentially inputs sampling data of n sampling points, and then the CPU 301 counts number N of zero-cross points (in a step S32). At each zero-cross point, sign of each sampling data is inverted. Thereafter, the CPU 301 transmits information including the number N of zero-cross points to the display control circuit 311 via the bus line 315. Normally, the display control circuit 311 displays a predetermined image on the display screen of the display unit 313 based on the image information read from the image memory 305. However, when the CPU 301 transmits the information including the number N of zero-cross points to the display control circuit 311, the display control circuit 311 controls the color parameters of the display image in response to this number N of zero-cross points.

Next, detailed description will be given with respect to the above control of color parameters by referring to the flowchart shown in FIG. 8. In general, when the number of zero-cross points is large, the musical tone will have impressions of cheerfulness and sweetness. In this case, it is possible to raise the compatibility between the musical tone and the display image by varying the main color of the display image to warm colors and by raising the saturation of the display image. The present fifth embodiment is designed based on this idea.

In FIG. 8, in the case where the number N of zero-cross points is relatively small and smaller than or equal to a first predetermined number $X_1$ (i.e., $0 \leqq N \leqq X_1$), color components of the display image is controlled to be fewer so that the display image will become a monotone color image main1y colored by gray color and the like (in steps S33 and S34). In the case where the number N of zero-cross points is larger than the number $X_1$ but smaller than or equal to a second predetermined number $X_2$ (i.e., $X_1 < N \leqq X_2$), the display image is controlled to become a color image main1y colored by cool colors and the like (in steps S35 and S36). In the case where the number N of zero-cross points is larger than the number $X_2$ but smaller than or equal to a third predetermined number $X_3$ (i.e., $X_2 < N \leqq X_3$), the display image is controlled to become a color image main1y colored by intermediate colors and the like (in steps S37 and S38). Further, in the case where the number N of zero-cross points is larger than the number $X_3$ but smaller than or equal to a fourth predetermined number $X_4$ (i.e., $X_3 < N \leqq X_4$), the display image is controlled to become a color image main1y colored by warm colors and the like (in steps S39 and S40). Furthermore, in the case where the number N of zero-cross points is larger than the number $X_4$, luminance (or brightness) of the display image is controlled to be higher but the color components and contrast thereof is controlled to be lower, so that the display image will be controlled to become a color image main1y colored by white color as a whole (in a step S41).

The above-mentioned operation is repeatedly performed by every predetermined sampling timings, i.e., by every predetermined period. Thus, color distribution of the display image will be adjusted in response to the number of zero-cross points of the input signal.

SIXTH EMBODIMENT

Figure 9:
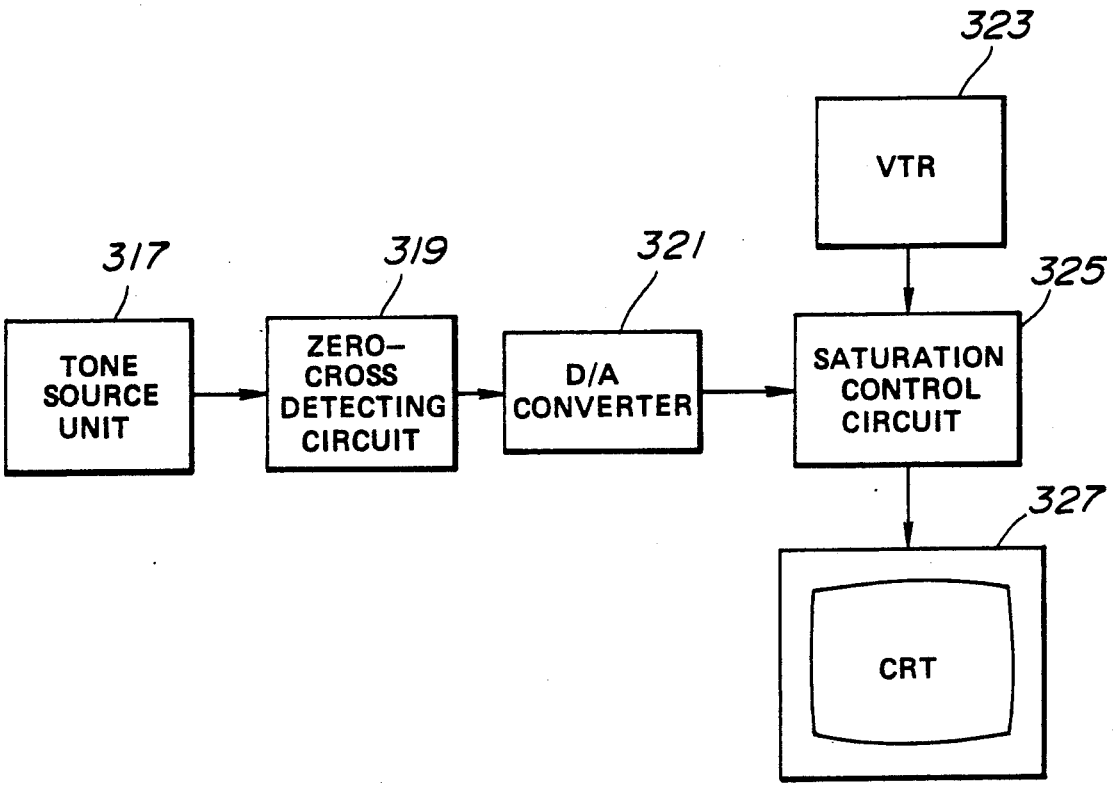
FIG. 9 is a block diagram showing a diagrammatical constitution of a tone visualizing apparatus according to a sixth embodiment of the present invention.

FIG. 9 shows the diagrammatical constitution of the tone visualizing apparatus according to the sixth embodiment of the present invention. The apparatus shown in FIG. 9 comprises a tone source unit 317; a zero-cross detecting circuit 319; a digital-to-analog (D/A) converter 321; a VTR unit 323; a saturation control circuit 325; and a display unit 327 such as the CRT display unit. The zero-cross detecting circuit 319 can be constituted by a limiter, an edge detecting circuit and a counter etc., for example. This limiter amplifies and also limits amplitude of the input signal, the edge detecting circuit detects rising edge and trailing edge of the output signal of the limiter, and then the counter counts the output pulses of the edge detecting circuit. Next, the saturation control circuit 325 can be constituted by a variable gain circuit which varies gain of color signal outputted from the VTR unit 323 by every color, for example.

In the apparatus shown in FIG. 9, the zero-cross detecting circuit 319 counts the number of zero-cross points of the signal such as the musical tone signal outputted from the tone source unit 317 by every unit time, and then the zero-cross detecting circuit 319 outputs a digital signal representative of a count value of the number of zero-cross points to the D/A converter 321. The D/A converter 321 converts this digital signal into an analog signal, which is supplied to the variable gain circuit within the saturation control circuit 325 as a control signal. For example, in the case where the number of zero-cross points of the inputted musical tone signal is relatively large, voltage of the output signal of the D/A converter 321 must become higher. In this case, the saturation of the display image can be controlled to be higher by use of a method for increasing color components of the image signal outputted from the VTR unit 323 but decreasing luminance signal component, for example. Incidentally, color signal process of the saturation control circuit 325 can be divided into three processes of the R, G, B colors. In addition, this process can be divided into luminance signal process and color signal process.

As described heretofore, according to the fifth and sixth embodiments, the color parameters of the display image is controlled in response to the number of zero-cross points of the audio signal such as the musical tone signal. This number of zero-cross points includes information of pitch or harmonic construction etc. of the musical tone. This information has data representative of the feelings of cheerfulness, sweetness and the like as an impression given by the musical tone. Hence, the number of zero-cross has high correlation with the color parameters such as the saturation and the color distribution etc. Therefore, it is possible to coincide the feeling of the musical tone with the feeling of the display image by controlling the color parameters of the display image in response to the number of zero-cross points of the musical tone signal.

SEVENTH EMBODIMENT

Figure 10:
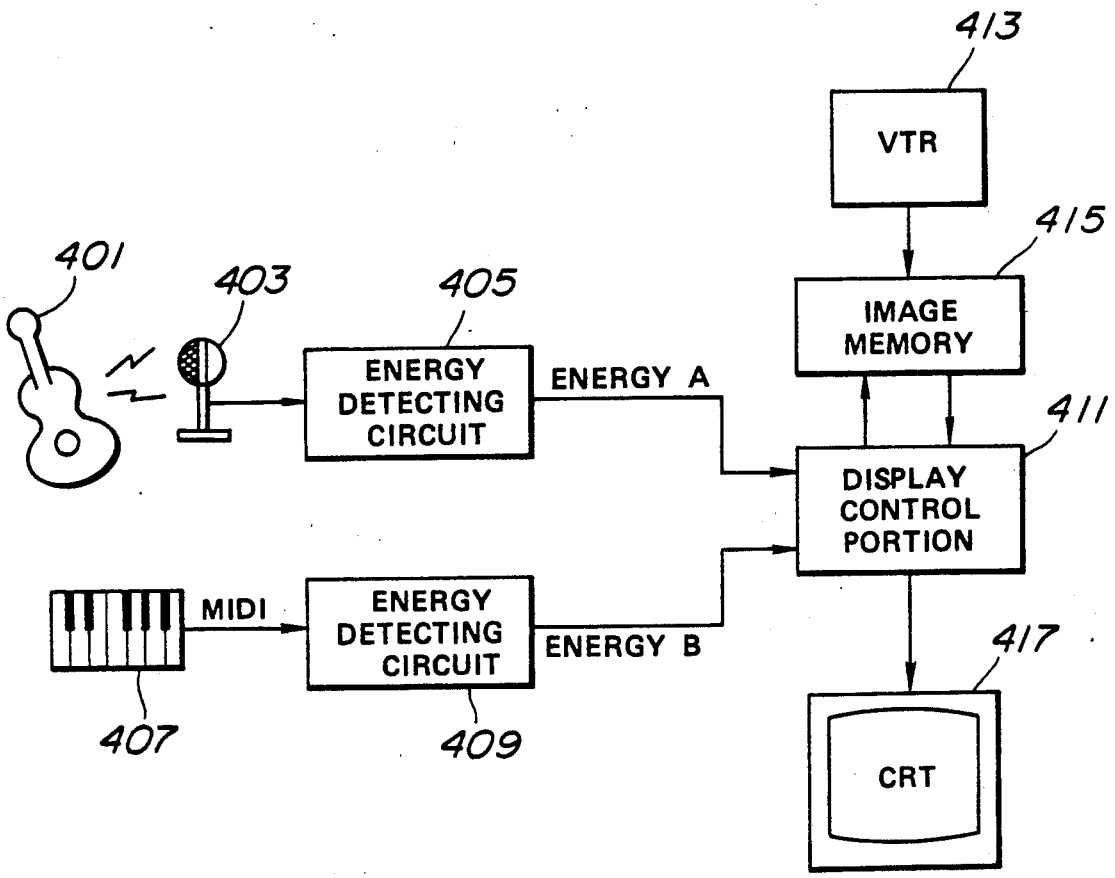
FIG. 10 is a block diagram showing a diagrammatical constitution of a tone visualizing apparatus according to a seventh embodiment of the present invention.

FIG. 10 shows the diagrammatical constitution of the tone visualizing apparatus according to the seventh embodiment of the present invention. The apparatus shown in FIG. 10 includes a microphone 403 for receiving tones of non-electronic musical instrument such as a violin, a piano, a guitar and the like; an energy detecting circuit 405 for detecting energy outputted from the non-electronic musical instrument 401; an energy detecting circuit 409 which is directly connected to an electronic musical instrument to thereby detect its output energy; and a display control portion 411 for performing display control of the image based on energy information outputted from each of the energy detecting circuits 405 and 409. As the display control portion 411, the microprocessor is used, for example. As image information outputting source, a VTR 413 is used. In order to store the image information outputted from the VTR 413, an image memory 415 is connected so that the image memory 415 can mutually exchange the image information with the display control portion 411. As means for displaying the image information outputted from the display control portion 411, an image display unit 417 such as the CRT display unit is adopted.

In the apparatus shown in FIG. 10, the musical tone outputted from the non-electronic musical instrument 401 is detected by the microphone 403, and then energy quantity thereof is detected as output energy quantity A in the energy detecting circuit 405. The energy detecting circuit 409 is connected to the electronic musical instrument 407 by the MIDI standard, and this energy detecting circuit 409 calculates out output energy quantity B of the electronic musical instrument 407 based on performance information which is inputted thereto in response to performance of the electronic musical instrument 407. More specifically, the energy detecting circuit 409 selects a table provided by tone color number in advance based on the musical tone information which is inputted thereto by the MIDI standard. Then, the energy detecting circuit 409 calculates out the output energy quantity B by use of key code information and key operation information (i.e., key-on and key-off information) by referring to the selected table. The method for calculating out this output energy quantity B will be described later.

As described above, the display control portion 411 calculates out ratio A/B by use of the energy quantities A and B respectively outputted from the energy detecting circuit 405 and 409. Then, the display control portion 411 obtains value k(A/B) by multiplying the ratio A/B by coefficient k which is experimentally determined. Hence, the image displayed by the display unit 417 is controlled based on this value k(A/B). More specifically, the image memory 415 inputs the predetermined image information outputted from the VTR 413, for example. In this case, the display control portion 411 sequentially gives access to the image memory 415 to thereby read out its image information, and then the image is displayed on the display screen of the display unit 417 based on such read image information.

During the above-mentioned operation, access address of the image memory 415 is changed in response to the value k(A/B) which is obtained as described above. In the case where the output energy quantity A is larger than the output energy quantity B, the display unit 417 displays the fine image under control of the display control portion 411. On the contrary, in the case where the output energy quantity B is larger than the output energy quantity A, the display unit 417 displays the roughly mosaic-shaped image under control of the display control portion 411. In other words, the roughly mosaic-shaped image represents hard and mechanical image of the electronic musical instrument, while the fine image represents the natural image of the non-electronic musical instrument. More concretely, in the case where the output energy quantity B is larger than the output energy quantity A, the display control portion 411 decreases access times of the image memory 415. In other words, the display control portion 411 reduces (or thins out) the image information to thereby obtain the rough mosaic-shaped image. Such mosaicking technique has been well known, hence, detailed description thereof will be skipped.

As described above, the size of each mosaic on the display screen is controlled in response to the ratio between the output energy quantity A of the non-electronic musical instrument and the output energy quantity B of the electronic musical instrument. Instead of the size of mosaic, it is possible to control display parameters such as the color, the brightness and the like in this case, for example.

Figure 11A:
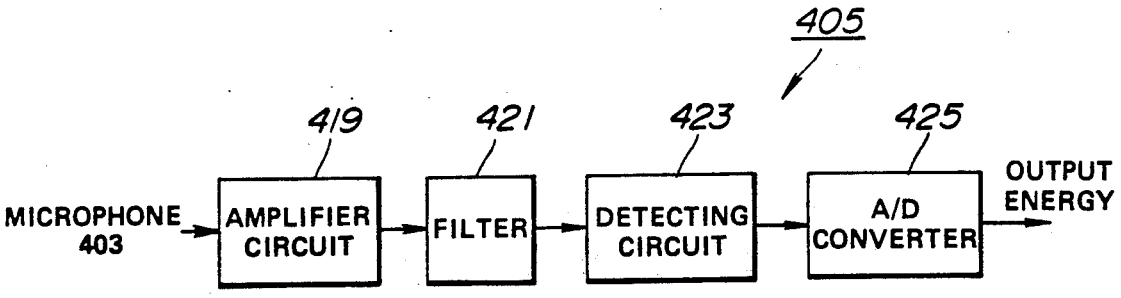
FIG. 11A is a block diagram showing a detailed constitution of an energy detecting circuit for non-electronic musical instrument provided in the apparatus shown in FIG. 10.

FIG. 11A shows the concrete constitution of the energy detecting circuit 405 for detecting the output energy of the non-electronic musical instrument 401 in the apparatus shown in FIG. 10. This energy detecting circuit shown in FIG. 11A comprises an amplifier circuit 419 for inputting the signal outputted from the microphone 403, a filter 421, a detecting circuit 423 and an A/D converter 425.

In this circuit shown in FIG. 11A, the musical tone signal collected by the microphone 403 is amplified by the amplifier circuit 419, and then the filter 421 selects predetermined frequency band of the amplified musical tone signal or the filter 421 gives the predetermined transmission characteristic to the amplified musical tone signal. Thereafter, the output signal of the filter 421 is subjected to Amplitude Modulation (AM) detection in the detecting circuit 423, for example. Thus, it is possible to obtain the signal whose level is proportional to the energy quantity of the musical tone signal from the detecting circuit 423. This output signal of the detecting circuit 423 is converted into the digital signal in the A/D converter 425, and then this digital signal is supplied to the display control portion 411 shown in FIG. 10.

Figure 11B:
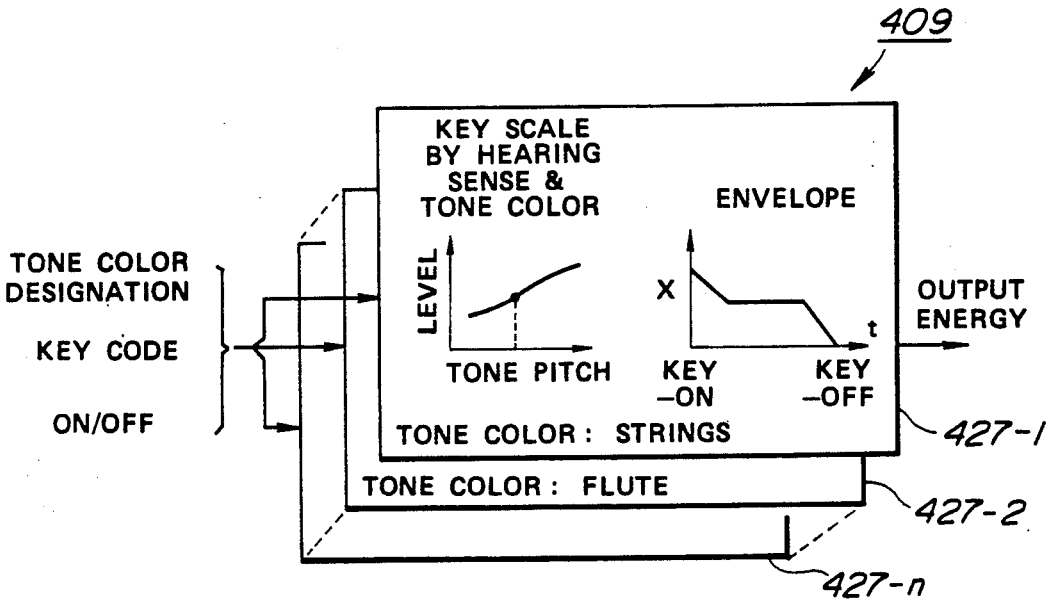
FIG. 11B is a conceptual view for explaining a principle of the energy detecting circuit for non-electronic musical instrument shown in FIG. 11A.

FIG. 11B shows the conceptual constitution of the energy detecting circuit 409 for electronic musical instrument shown in FIG. 10. As shown in FIG. 11B, the energy detecting circuit 409 provides tables 427-1 to 427-n each for calculating out the output energy by each tone color. In this case, the energy detecting circuit 409 gives access to the table corresponding to tone color number information included in the musical tone information which is inputted thereto from the electronic musical instrument 407 by the MIDI standard. Each table includes a first table for key scale and a second table for envelope which represents variation of output signal (or envelope) in a period between key-on time and key-off time. The first table for key scale pre-stores output levels each corresponding to each tone pitch of depressed key. Because, the output level is varied by key kind in the electronic musical instrument in general.

In the above-mentioned constitution, tone color of the strings is now designated by the inputted tone color number, for example. In this case, the energy detecting circuit 409 gives access to the table 427-1 for the strings, and then the level is determined based on the first table for key scale in accordance with the tone pitch of the depressed key. In addition, the access is given to the second table for envelope in response to the time passed from the key-on time so that the output value is determined. Thereafter, the value of the level obtained from the first table for key scale is multiplied by the output value obtained from the second table for envelope so that the output energy quantity is obtained at each timing. As described heretofore, the output energy quantity is obtained in correspondence with each tone color. Then, the output energy quantities of some tone colors are mixed together so that the mixed energy quantities are outputted as the output energy quantity B.

Figure 12:
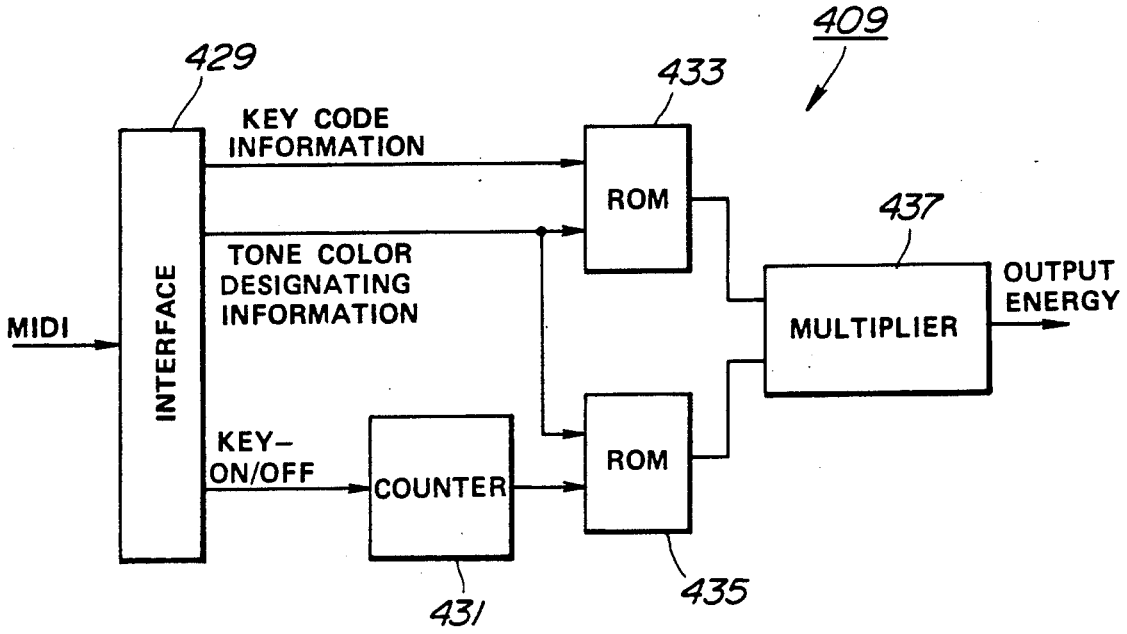
FIG. 12 is a block diagram showing a concrete constitution of an energy detecting circuit for electronic musical instrument.

FIG. 12 shows a detailed circuit constitution of the energy detecting circuit 409 for electronic musical instrument as shown in FIG. 11B. This energy detecting circuit 409 shown in FIG. 12 comprises an interface circuit (I/F) 429 which can be connected to the electronic musical instrument 407 by the MIDI standard, a counter 431 for counting the timings passed from the key-on time, two ROM 433 and 435 each storing the tables and a multiplier 437 for multiplying output values of two ROM 433 and 435.

In FIG. 12, the interface circuit 429 receives the musical tone information supplied from the electronic musical instrument 407 by the MIDI standard, and then the interface circuit 429 distributes this received musical tone information to several portions in the circuit shown in FIG. 12. The ROM 433 pre-stores the first table for key scale by every tone color, while the ROM 435 pre-stores the second table for envelope by every tone color as shown in FIG. 11B. When the musical tone information is supplied to the energy detecting circuit 409 from the electronic musical instrument 407 by the MIDI standard, the key code information and tone color designating information within the musical tone information are inputted into the ROM 433, from which the output level corresponding to the designated tone color can be obtained. Meanwhile, key-on signal starts the counter 431 performing its count operation, and the count value of this counter 431 is used as the address for accessing the second table for envelope stored in the ROM 435. At this time the tone color designating information inputted via the interface circuit 429 selects the table of corresponding tone color. The output of the ROM 435 designates a level value indicative of the time passed from the key-on time.

Therefore, this level value outputted from the ROM 435 is multiplied by the output level value of the ROM 433 so that the output energy quantity B will be obtained as described before.

Incidentally, in the seventh embodiment, the energy quantity A is obtained by effecting the AM detection on the musical tone signal. However, the present invention is not limited to this modification. Hence, it is possible to modify the seventh embodiment so that the energy quantity A can be obtained by instantaneously sampling the musical tone signal by certain period.

EIGHTH EMBODIMENT

Figure 13:
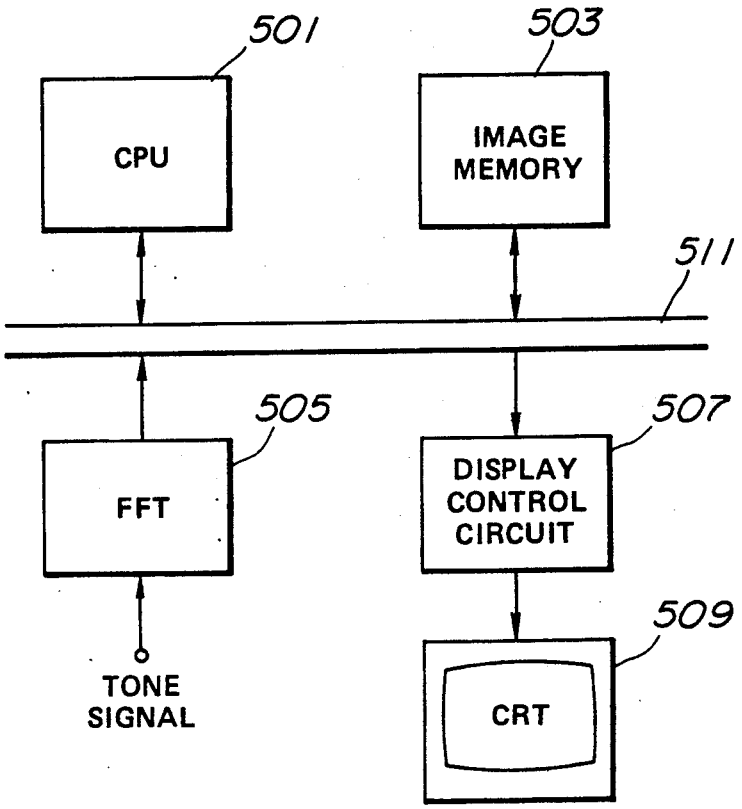
FIG. 13 is a block diagram showing a diagrammatical constitution of a tone visualizing apparatus according to an eighth embodiment of the present invention.
Figure 14:
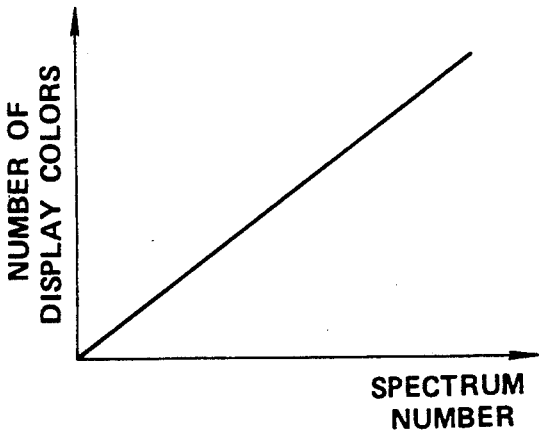
FIG. 14 is a graph showing relation between spectrum number of the musical tone signal and number of display colors in the eighth embodiment shown in FIG. 13.

Lastly, description will be given with respect to the eighth embodiment of the present invention in conjunction with FIGS. 13 and 14. The eighth embodiment shown in FIG. 13 has the constitution identical to that of the fourth embodiment shown in FIG. 5, hence, description thereof will be skipped. However, the control function of the eighth embodiment is different from that of the fourth embodiment Accordingly, description will be given with respect to the control function of the eighth embodiment as described below.

First, a FFT circuit 505 divides inputted tone signal into frequency spectrum signals by the know technique, and then the FFT circuit 505 counts number of frequency spectrum signals each having the level which is higher than predetermined level to thereby generate data representative of spectrum number (i.e., spectrum number data). Such spectrum number data are generated by every predetermined period and then supplied to a CPU 501. Then, the CPU 501 transmits this spectrum number data to a display control circuit 507 via a bus line 511. The display control circuit 507 reads predetermined image information from an image memory 503, and then the display control circuit 507 displays predetermined image on a display screen of a display unit 509 by use of this read image information. In this case, contents of display image are not restrictive, and it is possible to display a geometrical pattern on the display screen of the display unit 509, for example.

Further, the display control circuit 507 can vary number of display colors of the display image in response to the spectrum number data supplied thereto from the CPU 501. According to relation between the number of display colors and the spectrum number, it is possible to proportionally increase the number of display colors in response to increase of the spectrum number as shown in FIG. 14, for example. In the case where the spectrum number is small, the number of display colors is controlled to be small so that the displayed color image will become similar to black-and-white image which gives a simple impression to an audience (or viewer). On the contrary, as the spectrum number becomes larger, the display image becomes gayer. In other words, the gay image having large number of display colors corresponds to the gay impression given by the tone which has many spectrums and harmonics, while the image having small number of display colors and giving the simple impression to the audience corresponds to the tone having small spectrum number and few harmonics.

Incidentally, in order to control the number of display colors, it is possible to sequentially remove color data from the image information read from the image memory 503 in accordance with predetermined order and in response to the spectrum number. Or, it is possible to remove color signal included in the image signal supplied to the display unit 509 in response to the spectrum number.

Above is the description of the preferred embodiments of the present invention. This invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A tone visualizing apparatus, comprising:

(a) detecting means for detecting a musical tone parameter of an inputted audio signal;

(b) image display means for displaying an image of an object based on predetermined image information; and (c) display control means for controlling a sense of distance of said object displayed by said image display means in response to a variation of said musical tone parameter.

2. A tone visualizing apparatus according to claim 1 wherein said display control means controls the sense of distance of said object by varying the mutual relation between said object and a background image.

3. A tone visualizing apparatus according to claim 1 wherein said display control means controls the sense of distance of said object by varying a position relation of said object displayed within a background image

4. A tone visualizing apparatus according to claim 1 wherein said image display means is a three-dimensional image display unit capable of adjusting the sense of distance of said object three-dimensionally.

5. A tone visualizing apparatus according to claim 1 wherein said musical tone parameter is an envelope of said inputted audio signal.

6. A tone visualizing apparatus according to claim 1 wherein said musical tone parameter is one of tone volume, tone color, and frequency.

7. A tone visualizing apparatus, comprising:

(a) an image memory for storing image information in advance;

(b) envelope detecting means for detecting an envelope of an inputted audio signal;

(c) display means for displaying an image of an object based on said image information; and (d) display control means for controlling said display means so that said object is changed in size in response to a detected envelope of said inputted audio signal.

8. A tone visualizing apparatus according to claim 7, further comprising:

an analog-to-digital converter for converting an envelope signal representative of the detected envelope of said inputted audio signal into a digitized envelope signal which is transmitted to said display control means at each one of a number of predetermined timings.

9. A tone visualizing apparatus, comprising:

(a) chord detecting means for detecting a chord based on one of a musical tone signal and musical tone performance information;

(b) image display means for displaying an image based on predetermined image information; and (c) display control means for varying contents of said image information in response to a chord detected by said chord detecting means.

10. A tone visualizing apparatus according to claim 9 wherein said chord detecting means detects a chord based on a combination of depressed keys of an electronic musical instrument.

11. A tone visualizing apparatus according to claim 9 wherein said display control means varies characters of feelings (i.e., happy, angry, sad and comfortable feelings) of the image in response to the chord detected by said chord detecting means.

12. A tone visualizing apparatus according to claim 9 wherein said image display means displays an image including a human face so that said display control means varies an expression of the displayed human face in response to the chord detected by said chord detecting means.

13. A tone visualizing apparatus according to claim 12 wherein said image display means display means displays the image including the human face, the displayed human face being controlled to be brightened up when the chord detected by said chord detecting means is a major chord and being controlled to be darkened when the detected chord is a minor chord.

14. A tone visualizing apparatus, comprising:

(a) chord detecting means for detecting a chord based on one of a musical tone signal and musical tone performance information;

(b) chord storing means for sequentially storing a predetermined amount of chord information outputted from said chord detecting means;

(c) image display means for displaying an image based on predetermined image information;

(d) chord progress detecting means for detecting a chord progress pattern based on each chord information stored in said chord storing means; and (e) display control means for varying contents of the image information in response to the chord progress pattern detected by said chord progress detecting means.

15. A tone visualizing apparatus according to claim 14 wherein said display control means varies characters of feelings (i.e., happy, angry, sad and comfortable feelings) of the image in response to the chord progress pattern detected by said chord progress detecting means.

16. A tone visualizing apparatus according to claim 14 wherein said image display means displays an image including a human face so that said display control means varies an expression of a displayed human face in response to the chord progress pattern detected by said chord progress detecting means.

17. A tone visualizing apparatus according to claim 15 wherein said chord progress detecting means obtains parameter values of feelings by executing pattern matching between the detected chord information and predetermined data base so that said display control means varies characters of feelings of the image in response to the parameter values.

18. A tone visualizing apparatus according to claim 17 wherein each parameter value of each feeling is evaluated based on human response.

19. A tone visualizing apparatus, comprising:

(a) spectrum extracting means for extracting a fundamental wave component having frequency $f_B$ and at least one higher harmonic component having frequency $f_n$ other than said fundamental wave component from spectrum signals included in an inputted audio signal;

(b) comparing means for calculating out n (where n denotes an integral number) times of said frequency $f_B$ (i.e., $n \times f_B$) which is the closest value of said frequency $f_n$, said comparing means comparing the value $n \times f_B$ with said frequency $f_n$ to thereby obtain a frequency difference $P_n$ therefore;

(d) display control means for varying one of content and display state of the image displayed by said image display means in responses to said frequency difference $P_n$.

20. A tone visualizing apparatus according to claim 19 wherein said display control means varies color balance of the display image in response to said frequency difference $P_n$.

21. A tone visualizing apparatus according to claim 19 wherein said display control means varies color intensity of the display image in response to said frequency difference $P_n$.

22. A tone visualizing apparatus according to claim 19 wherein said display control means varies at least one of a frequency characteristic and a phase characteristic of the display image in response to said frequency difference $P_n$.

23. A tone visualizing apparatus according to claim 19 wherein said n is the predetermined integral value.

24. A tone visualizing apparatus according to claim 19 wherein said frequency $f_n$ is divided by said frequency $f_B$ to thereby obtain a value y the closest integral number of which is set as said value n.

25. A tone visualizing apparatus comprising:

(a) zero-cross detecting means for detecting and counting zero-cross points of an inputted musical tone signal;

(b) image display means for displaying an image based on predetermined image information; and (c) display control means for varying said image information to thereby vary color parameters of the image displayed by said image display means in response to number of said zero-cross points detected by said zero-cross detecting means.

26. A tone visualizing apparatus according to claim 25 wherein said display control means controls said image display means so that the display image will become an image colored by cool colors when the number of said zero-cross points is relatively small, while said display control means controls said image display means so that the display image will become an image colored by warm colors when the number of said zero-cross points is relatively large.

27. A tone visualizing apparatus according to claim 25 wherein said display control means controls said image display means so that saturation of the display image will become higher in response to increase of the number of said zero-cross points.

28. A tone visualizing apparatus according to claim 25 wherein four numbers $X_1$, $X_2$, $X_3$ and $X_4$ (where $X_1<X_2<X_3<X_4$) are predetermined with respect to number N of said zero-cross points, said display control means controls said image display means so that the display image will become a monotone color image mainly colored by gray color in case of $0<N<X_1$, the display image being controlled to become an image mainly colored by cool colors in case of $X_1<N<X_2$, the display image being controlled to become an image mainly colored by intermediate colors in case of $X_2<N<X_3$, the display image being controlled to become an image mainly colored by warm colors in case of $X_3<N<X_4$, and the display image being controlled to become an image mainly colored by white color in case of $X_4<N$.

29. A tone visualizing apparatus comprising:
(a) tone source means for generating a musical tone signal;
(b) zero-cross detecting means for detecting and counting a number of zero-cross points of said musical tone signal to thereby output a digital signal whose data represent the number of zero-cross points;
(c) digital-to-analog converting means for converting said digital signal into an analog signal;
(d) image information generating means for generating image information;
(e) image display means for displaying an image gased on said image information outputted from said image information generating means; and
(f) saturation control means for controlling saturation of said image in response to the level of said analog signal outputted from said digital-to-analog converting means.

30. A tone visualizing apparatus according to claim 29 wherein said saturation control means controls said image display means so that the saturation of the display image will be raised when the number of zero-cross points is relatively large, while said saturation control means controls said image display means so that the saturation of the display image will be lowered when the number of zero-cross points is relatively small.

31. A tone visualizing apparatus, comprising:
(a) first energy detecting means for detecting a first output energy quantity of a first musical tone generating source;
(b) second energy detecting means for detecting a second output energy quantity of a second musical tone generating source;
(c) ratio detecting means for detecting a ratio between said first and second output energy quantities to thereby generate an output value thereof corresponding to the detected ratio;
(d) image display means for displaying an image based on predetermined image information; and
(e) display control means for varying contents ;of said image information based on the output value of said ratio detecting means.

32. A tone visualizing apparatus according to claim 31 wherein said first musical tone generating source is a non-electronic musical instrument and said second musical tone generating source is an electronic musical instrument.

33. A tone visualizing apparatus according to claim 31 or 32 wherein said image display means mosaics said image and said display control means varies the size of each mosaic in response to the output value of said ratio detecting means.

34. A tone visualizing apparatus according to claim 31 or 32 wherein said display control means varies contents of said image displayed by said image display means in response to the output value of said ratio detecting means.

35. A tone visualizing apparatus according to claim 32 wherein said first musical tone generating source includes a microphone for collecting a musical tone generated by said non-electronic musical instrument to thereby output a musical tone signal.

36. A tone visualizing apparatus comprising:
(a) first energy detecting means for detecting a first output energy quantity of a first musical tone generating source;
(b) second energy detecting means for detecting a second output energy quantity of a second musical tone generating source;
(c) an image memory which stores image information;
(d) an image display which displays an image based on image information read from said memory; and
(e) display control means for calculating an energy ratio between said first and second output energy quantities to thereby read different image information from said image memory based on said energy ratio so that the image can be controlled.

37. A tone visualizing apparatus according to claim 36 wherein said first musical tone generating source includes a microphone for collecting a musical tone generated by a non-electronic musical instrument to thereby output a musical tone signal, while said second musical tone generating source is an electronic musical instrument.

38. A tone visualizing apparatus according to claim 36 wherein said first energy detecting means comprises:
(a) a filter for filtering out a musical tone signal having a predetermined frequency band from the musical tone signal outputted from said first musical tone generating source;
(b) detecting means for detecting said musical tone signal outputted from said filter to thereby output a signal whose level is proportional to the energy quantity of said musical tone signal; and
(c) an analog-to-digital converter for converting the output signal of said detecting means into a digital signal representative of said first output energy quantity of said first musical tone generating source.

39. A tone visualizing apparatus according to claim 38 wherein said detecting means is an Amplitude Modulation (AM) detector for effecting AM detection on said musical tone signal outputted from said filter.

40. A tone visualizing apparatus according to claim 36 wherein said second energy detecting means prestores tables each provided for each tone color, said each table including a first table for key scale and a second table for envelope, said first table storing output level in correspondence with each tone pitch and said second table storing data representative of variation of an output signal which varies in accordance with time passed from a key-on time, said second energy detecting means accessing said first and second tables so that the output level of said first table and output value of said second table will be obtained when the tone color and tone pitch are designated, whereby said second output energy quantity can be obtained by multiplying the output level of said first table by the output value of said second table.

41. A tone visualizing apparatus according to claim 40 wherein said second energy detecting means comprises:
(a) first memory means for storing said first table by each tone color;
(b) second memory means for storing said second table by each tone color;
(c) a counter for counting timings after the key-on time to thereby output a count value representative of the time passed from the key-on time, said count value being used for accessing said second table stored in said second memory means; and (d) a multiplier for multiplying the output level of said first table by the output value of said second table to thereby obtain said second output energy quantity.

42. A tone visualizing apparatus according to claim 41 wherein each of said first and second memory means is constituted by a read on1y memory (ROM).

43. A tone visualizing apparatus comprising:

(a) spectrum extracting means for extracting spectrum signal components from an inputted tone signal;

(b) image display means for displaying an image based on predetermined image information; and (c) display control means for controlling a number of display colors of said image displayed by said image display means in response to a number of said spectrum signal components.

44. A tone visualizing apparatus according to claim 43 wherein said spectrum extracting means comprises:

(a) FFT circuit for effecting the Fast Fourier Transform (FFT) on the inputted tone signal;

(b) level judging means for judging the level of each spectrum signal component to thereby extract spectrum signal components each having a level which is higher than a predetermined level from all spectrum signal components outputted from said FFT circuit; and (c) a counter for counting a number of said spectrum signal components extracted by said level judging means, whereby said display control means controls the number of display colors of said image in response to the number of said spectrum signal components counted by said counter.

45. A tone visualizing apparatus according to claim 44 wherein said display control means controls said image display means so that the number of display colors will be increased in response to an increase of the number of said spectrum signal components each having the level which is higher than said predetermined level.

46. A tone visualizing system which visualizes musical tones, comprising:

(a) a detector which detects at least one tone parameter of an inputted audio signal;

(b) a memory which stores image information representative of at least said one tone parameter of said audio signal, said one tone parameter representing energy of said musical tone;

(c) a display which displays an image based on said image information read from said memory; and (d) a controller which controls which image information is read from said memory in accordance with a detected tone parameter of said audio signal.

47. A tone visualizing system according to claim 46, wherein said memory is one of a video disc, a video tape, and a semiconductor.

* * * * *